US010770837B2

(12) United States Patent
Sawairi

(10) Patent No.: US 10,770,837 B2
(45) Date of Patent: Sep. 8, 2020

(54) CONNECTOR HAVING A SLIDER HOLDER

(71) Applicant: YAZAKI CORPORATION, Tokyo (JP)

(72) Inventor: Kaoru Sawairi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/554,582

(22) Filed: Aug. 28, 2019

(65) Prior Publication Data

US 2020/0076127 A1 Mar. 5, 2020

(30) Foreign Application Priority Data

Sep. 3, 2018 (JP) ..... 2018-164547

(51) Int. Cl.
*H01R 13/627* (2006.01)

(52) U.S. Cl.
CPC ..... *H01R 13/6275* (2013.01)

(58) Field of Classification Search
CPC ..... H01R 13/6275; H01R 12/4362; H01R 12/4364; H01R 12/4365; H01R 12/67; H01R 12/4368
USPC ..... 439/352
See application file for complete search history.

(56) References Cited

U.S. PATENT DOCUMENTS 6,234,826 B1 * 5/2001 Wilber ..... H01R 13/4368 439/352
6,435,895 B1 * 8/2002 Fink ..... H01R 13/6272 439/352
7,326,074 B1 * 2/2008 Lim ..... H01R 13/629 439/352
7,399,195 B2 * 7/2008 Kim ..... H01R 13/641 439/352
7,537,492 B2 * 5/2009 Fekonia ..... H01R 13/6273 439/701
9,281,619 B2 * 3/2016 Morello ..... H01R 13/6272
9,680,256 B1 * 6/2017 Lane ..... H01R 13/6275
2006/0240718 A1 * 10/2006 Osada ..... H01R 13/4365 439/752

FOREIGN PATENT DOCUMENTS

JP 2006-80025 A 3/2006

* cited by examiner

*Primary Examiner* — Harshad C Patel
(74) *Attorney, Agent, or Firm* — Kenealy Vaidya LLP

(57) ABSTRACT

A connector includes a housing and a slide holder. The housing includes a lock portion maintaining a completely fitted state with a mating housing. The slide holder is configured to be mounted on the housing so as to be movable in a fitting direction of the housing and the mating housing between a temporary locking position and a main locking position, and is movable from the temporary locking position to the main locking position while avoiding interference with the lock portion only in the completely fitted state. The housing includes a pair of protective walls extending in the fitting direction so as to sandwich the lock portion and the slide holder in a width direction orthogonal to the fitting direction.

2 Claims, 17 Drawing Sheets

CONNECTOR HAVING A SLIDER HOLDER

CROSS REFERENCE TO RELATED APPLICATIONS

This application claims priority from Japanese Patent Application No. 2018-164547 filed on Sep. 3, 2018, the entire contents of which are incorporated herein by reference.

BACKGROUND OF THE INVENTION

Field of the Invention

The present invention relates to a connector.

Description of Related Art

In the related art, it is widely known that a connector including a housing that includes a lock portion maintaining a completely fitted state with a mating housing is provided with a slide holder for detecting an incompletely fitted state between the housing and the mating housing (see, for example, Patent Literature 1).

The slide holder is mounted on the housing so as to be movable in a fitting direction of the housing and the mating housing between a temporary locking position and a main locking position, and is configured to be movable from the temporary locking position to the main locking position while avoiding interference with the lock portion only in the completely fitted state. That is, in the incompletely fitted state, the slide holder cannot move from the temporary locking position to the main locking position due to interference with the lock portion, so that the incompletely fitted state between the housing and the mating housing can be easily detected.

[Patent Literature 1] JP-A-2006-80025

According to a related art, a housing including a slide holder is provided with a pair of protective walls extending in a fitting direction so as to sandwich a lock portion and the slide holder in a width direction orthogonal to a fitting direction in order to protect the lock portion of the housing and the slide holder. That is, the pair of protective walls is provided so as to cover the lock portion and the slide holder from both sides in the width direction.

The connector where the slide holder is mounted on the housing is transported in a state in which the slide holder is held in the temporary locking position. However, during transport, the slide holder may unintentionally move from the temporary locking position to the main locking position due to contact with a peripheral member or the like. For this reason, it is required to visually see from the width direction that the slide holder is in the temporary locking position at a stage of the transport or a next step after the transport.

However, when the housing is viewed from the width direction, depending on the shape of the protective walls, the protective walls may become an obstacle to make it impossible to visually see whether the slide holder is in the temporary locking position. As described above, it is required to make it visible easily whether the slide holder in the housing provided with the pair of protective walls is in the temporary locking position.

SUMMARY

One or more embodiments provide a connector where it is easily visible from a width direction of the housing whether a slide holder mounted on a housing including a pair of protective walls is in a temporary locking position.

In an aspect (1), one or more embodiments provide a connector including a housing and a slide holder. The housing includes a lock portion maintaining a completely fitted state with a mating housing. The slide holder is configured to be mounted on the housing so as to be movable in a fitting direction of the housing and the mating housing between a temporary locking position and a main locking position, and is movable from the temporary locking position to the main locking position while avoiding interference with the lock portion only in the completely fitted state. The housing includes a pair of protective walls extending in the fitting direction so as to sandwich the lock portion and the slide holder in a width direction orthogonal to the fitting direction. The protective wall includes a notch which makes a part of the slide holder visible when the slide holder is in the temporary locking position, and makes the part of the slide holder invisible when the slide holder is in the main locking position when viewed from the width direction.

In an aspect (2), the housing and the slide holder may include locking structures for locking the slide holder in the temporary locking position. The slide holder and the pair of protective walls may include guide structures that guide the movement of the slide holder with respect to the housing. The guide structures may have relief portions for making the slide holder inclined with respect to the housing in a direction in which the interference of the locking structures is avoided when the slide holder is mounted on the housing.

According to the connector having the aspect [1], the protective walls are provided with notches respectively which make a part of the slide holder visible when the slide holder is in the temporary locking position, and make the part (same part) of the slide holder invisible when the slide holder is in the main locking position when viewed from the width direction. As a result, it is easily visible from the width direction of the housing whether the slide holder mounted on the housing including the pair of protective walls is in the temporary locking position.

According to the connector having the aspect [2], relief portions are provided in guide structures constituted by the slide holder and the pair of protective walls. As a result, in a state in which the slide holder is inclined with respect to the housing so as to avoid interference of locking structures constituted by the housing and the slide holder, the slide holder can be smoothly mounted on the housing and locked in the temporary locking position by using the guide structures without the interference of the locking structures. As a result, an engagement margin of the locking structures can be increased, and the slide holder can be more reliably locked in the temporary locking position.

Advantageous Effects of Invention

According to one or more embodiments, it is possible to provide the connector where it is easily visible from the width direction of the housing whether the slide holder mounted on the housing including the pair of protective walls is in the temporary locking position.

The present invention has been briefly described as above. Further, details of the present invention will be clarified by reading a mode for carrying out the invention to be described below with reference to accompanying drawings.

DESCRIPTION OF EMBODIMENTS

<Embodiment>

Figure 1:
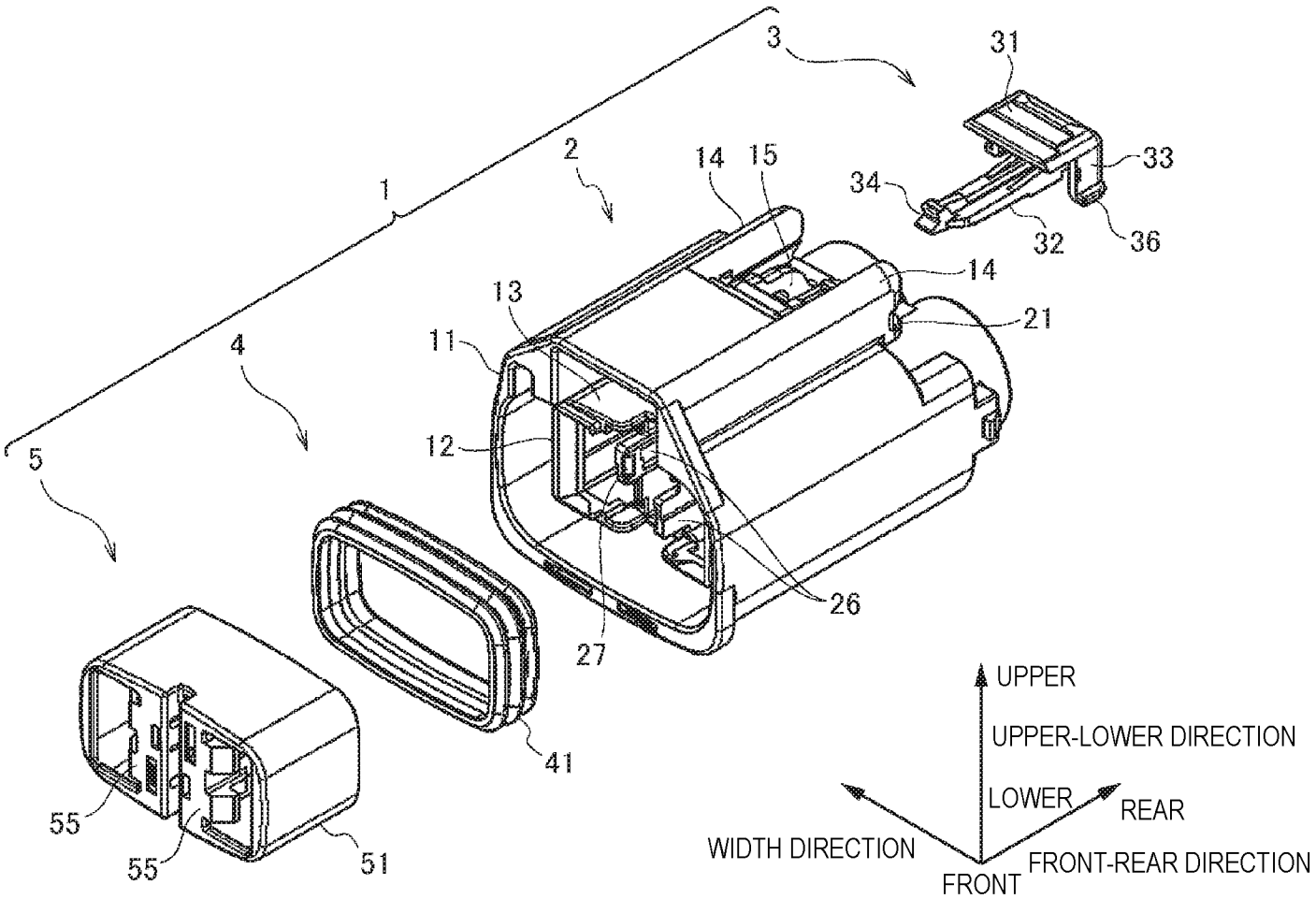
FIG. 1 is an exploded perspective view of a connector according to an embodiment.
Figure 2A:
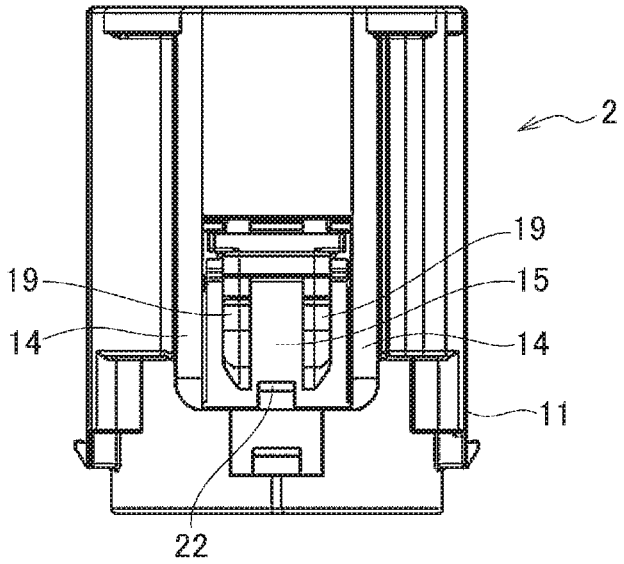
FIG. 2A is a top view of a housing shown in FIG. 1.
Figure 2B:
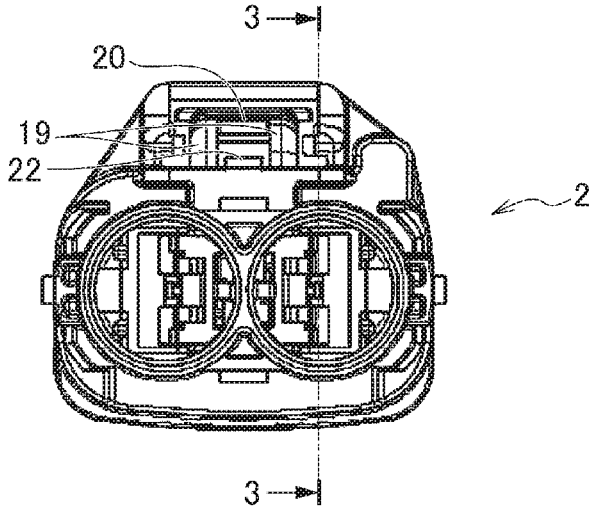
FIG. 2B is a rear view of the housing.

Hereinafter, a connector 1 according to an embodiment of the present invention will be described with reference to the drawings. Hereinafter, as shown in FIG. 1, a "front-rear direction", a "width direction", an "upper-lower direction", "front", "rear", "upper", and "lower" are defined for convenience of description. The "front-rear direction", the "width direction", and the "upper-lower direction" are orthogonal to one another. The front-rear direction coincides with a fitting direction of the connector 1 and a mating connector (not shown), and a front side (left side in FIG. 1) in the fitting direction in which the mating connector is fitted is a front side, and a back side (right side in FIG. 1) in the fitting direction opposite to the mating direction is a rear side.

As shown in FIG. 1, the connector 1 includes a housing 2, a slide holder 3 mounted on an upper portion of the housing 2, a packing 4 mounted on the housing 2 from the front side, and a front holder 5 mounted on the housing 2 from the front side. First, a configuration of a portion related to mounting of the slide holder 3 on the housing 2 and a configuration of the slide holder 3 will be described.

<Portion Related to Mounting of Slide Holder 3 on Housing 2 and Slide Holder 3>

First, a portion relating to the mounting of the slide holder 3 on the housing 2 will be described. As shown in FIGS. 1, 2A, 2B and 3, the housing 2 made of resin includes an outer cylindrical portion 11 having a substantially rectangular cylindrical shape. A terminal housing portion 12 is integrally provided inside the outer cylindrical portion 11 so as to form an annular gap that opens to the front side. The annular gap functions as a space into which a frame body portion 51 (to be described later) of the front holder 5 is inserted when the front holder 5 is mounted.

A central portion in the width direction of a front side portion of an upper wall constituting the outer cylindrical portion 11 bulges upward. An insertion space 13 for a mating lock portion into which a mating lock portion (not shown) of a mating housing is inserted as formed below the bulging portion so as to communicate with the annular gap.

A pair of protective walls 14 is integrally provided on a rear side part of the upper wall constituting the outer cylindrical portion 11 so as to extend rearward from both end portions in the width direction of the bulging portion and face each other in the width direction. A space between the pair of protective walls 14 functions as a slide holder mounting space 15 for mounting the slide holder 3. The slide holder mounting space 15 communicates with the insertion space 13 for a mating lock portion in the front-rear direction (see FIG. 3). The slide holder 3 is inserted into and mounted on the slide holder mounting space 15 from a rear side.

Figure 3:
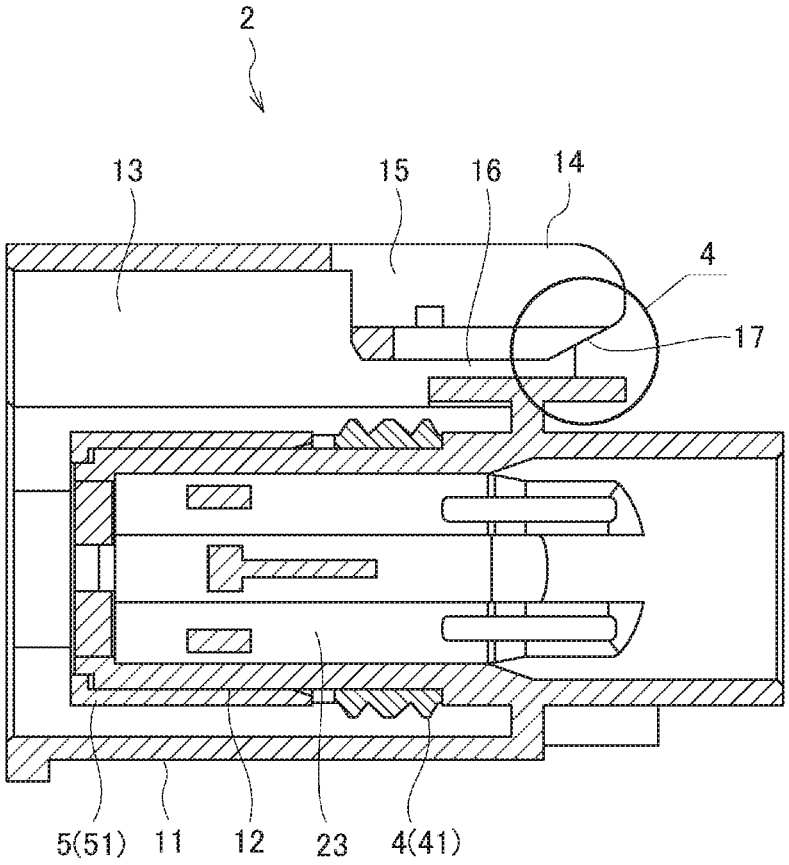
FIG. 3 is a sectional view taken along a line 3-3 of FIG. 2B.
Figure 4:
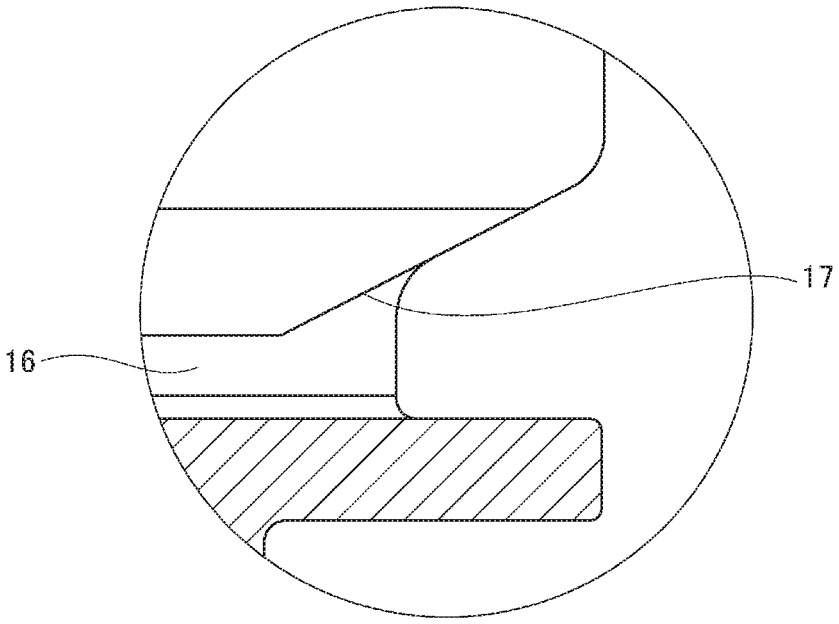
FIG. 4 is an enlarged view of an inside of a frame indicated by a reference numeral 4 in FIG. 3.
Figure 5A:
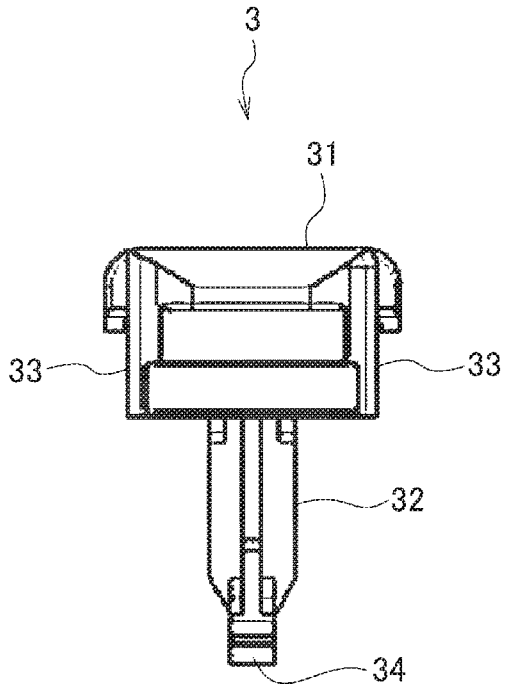
FIG. 5A is a top view of a slide holder shown in FIG. 1.
Figure 5B:
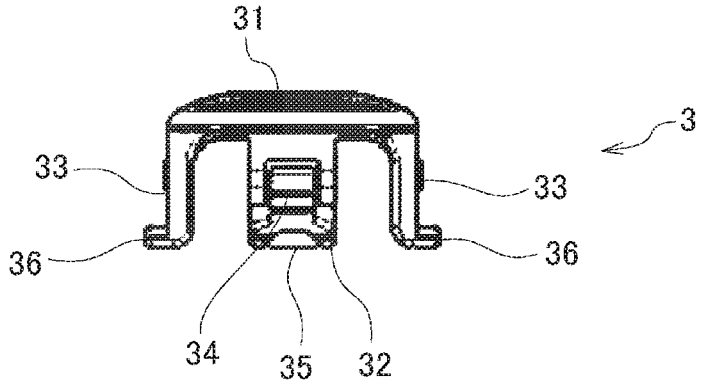
FIG. 5B is a front view of the slide holder.
Figure 6A:
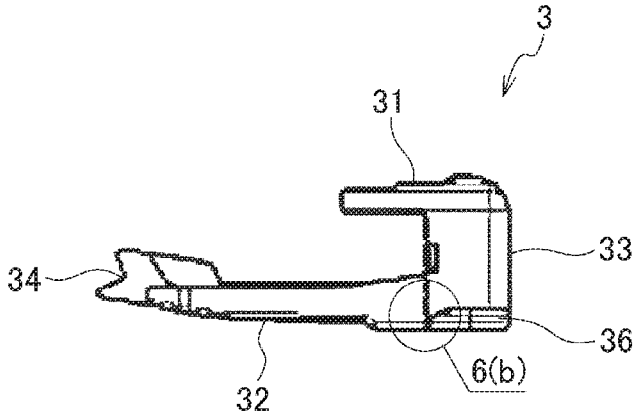
FIG. 6A is a side view of the slide holder.
Figure 6B:
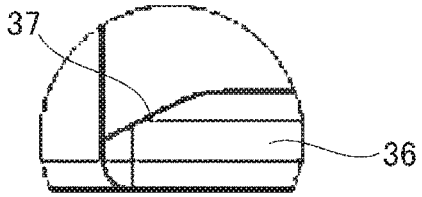
FIG. 6B is an enlarged view of an inside of a frame indicated by a reference number 6(*b*) in FIG. 6A.
Figure 7A:
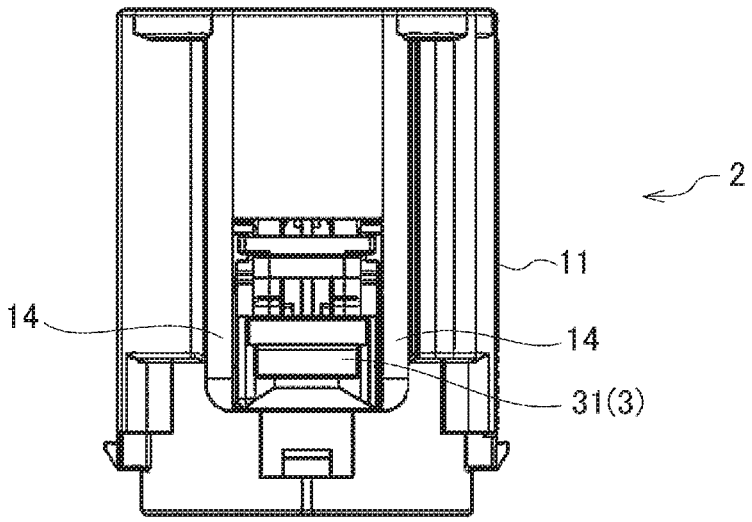
FIGS. 7A and 7B are views corresponding to FIGS. 2A and 2B in a state in which the slide holder is in a temporary locking position.
Figure 7B:
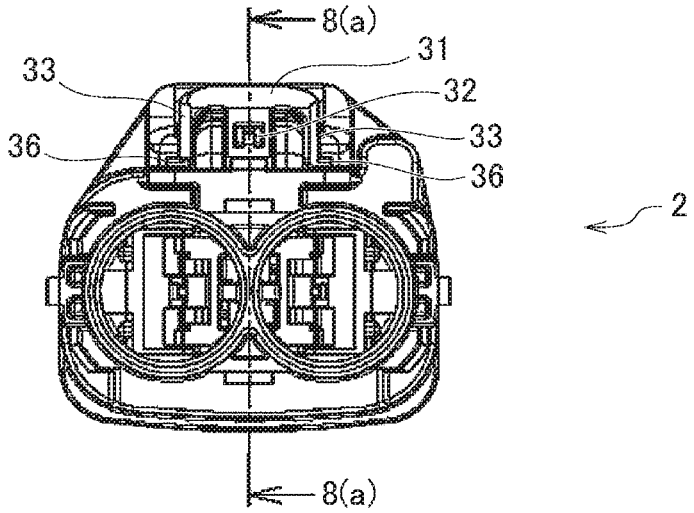

As shown in FIG. 3, a guide groove 16 recessed outward in the width direction for guiding the slide holder 3 is formed on a widthwise inner side surface of each protective wall 14 so as to extend in the front-rear direction. A tapered portion 17 of which an upper inner wall of the guide groove 16 is inclined rearward and upward is formed at a rear end portion of the guide groove 16 (that is, an end portion on a side where the slide holder 3 is inserted) (see also FIG. 4). The function of the tapered portion 17 will be described later.

Figure 8A:
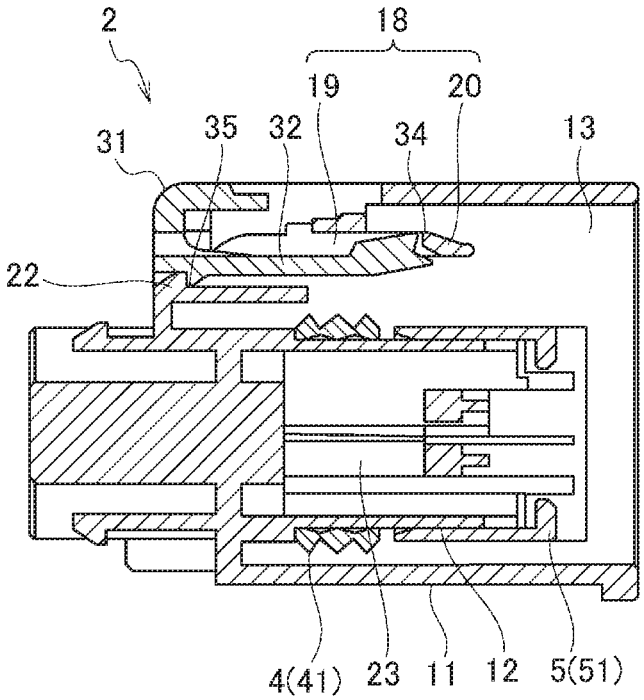
FIG. 8A is a cross-sectional view taken along a line 8(*a*)-8(*a*) of FIG. 7B.

As shown in FIG. 8A (see also FIG. 2), a lock portion 18 is integrally provided on the rear side part of the upper wall constituting the outer cylindrical portion 11. The lock portion 18 has a function of maintaining a completely fitted state between the housing 2 and the mating housing by engaging with the mating lock portion of the mating housing.

The lock portion 18 includes a pair of lock arms 19 extending forward from a rear end portion between the pair of protective walls 14 on the rear side part of the upper wall of the outer cylindrical portion 11 toward the insertion space 13 for a mating lock portion, and a connecting portion 20 that is connected to tip end portions of the pair of lock arms 19 in the width direction. When the mating lock portion is engaged with the connecting portion 20, the completely fitted state between the housing 2 and the mating housing is maintained.

Figure 8B:
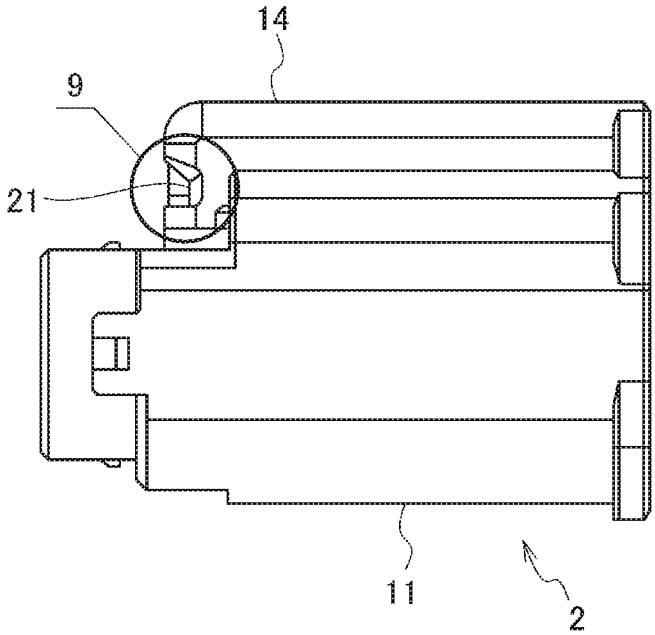
FIG. 8B is a side view of the housing in a state in which the slide holder is in the temporary locking position.

As shown in FIG. 8B (see also FIGS. 1 and 9), a notch 21 recessed forward is formed on a rear end surface of each protective wall 14. The function of the notch 21 will be described later.

As shown in FIG. 8A (also see FIG. 2), a protrusion 22 protruding upward is formed at a central portion in the width direction (between root portions of the pair of lock arms 19) of the rear end portion of the rear side part of the upper wall of the outer cylindrical portion 11. The protrusion 22 has a function of holding the slide holder 3 in a temporary locking position.

Next, the slide holder 3 will be described. As shown in FIGS. 1, 5A, 5B, 6A and 6B, the slide holder 3 made of resin integrally includes a rectangular flat plate-shaped main body portion 31, a detection arm 32 extending downward and forward from the central portion in the width direction of a rear end portion of the main body portion 31, and a pair of side plate portions 33 extending downward from both side edges in the width direction of the main body portion 31.

An engaging portion 34 (see also FIG. 8A) that engages with the connecting portion 20 of the lock portion 18 is formed at a tip end portion of the detection arm 32. A protrusion 35 protruding downward is formed on a lower surface of a root portion of the detection arm 32 (see also FIG. 5B). The slide holder 3 is held in the temporary locking position by engaging the protrusion 22 of the housing 2 with the protrusion 35 of the slide holder 3 (see FIG. 8A).

A guide rib 36 protruding outward in the width direction is formed so as to extend in the front-rear direction at a lower end edge portion of a widthwise outer side surface of each side plate portion 33. A tapered portion 37 in which an upper side inner wall of the guide rib 36 is inclined forward and downward is formed at a front end portion of the guide rib 36 (that is, the end portion of the slide holder 3 on the insertion side) (see also FIG. 6B). The function of the tapered portion 37 will be described later.

When the slide holder 3 described above is mounted on the housing 2, the slide holder 3 is brought close to the slide holder mounting space 15 of the housing 2 from the rear side. Then, as shown in FIG. 8A, the slide holder 3 is mounted on the housing 2 such that the pair of guide ribs 36 is inserted into the pair of guide grooves 16 and the protrusion 35 rides over the protrusion 22 and is located on a front side of the protrusion 22. Accordingly, as shown in FIG. 8A, the slide holder 3 is held in the temporary locking position.

At this time, since the tapered portion 17 is formed in the guide groove 16 and the tapered portion 37 is formed in the guide rib 36, compared with a case where the tapered portions 17, 37 are not formed, the slide holder 3 can be smoothly mounted on the housing 2 and locked in the temporary locking position without interference caused between the protrusion 35 and the protrusion 22 in a state in which the rear side of the slide holder 3 is inclined more upward than the front side with respect to the housing 2.

As shown in FIG. 8A, in the temporary locking position of the slide holder 3, the engaging portion 34 located at the tip end of the detection arm 32 of the slide holder 3 is engaged with the connecting portion 20 of the lock portion 18 of the housing 2. As a result, the slide holder 3 cannot move from the temporary locking position to the main locking position (see FIG. 11) that is forward of the temporary locking positon.

In this state, when the mating housing is fitted to the housing 2 to be in the completely fitted state, the completely fitted state of the housing 2 and the mating housing is maintained by engaging the mating lock portion with the connecting portion 20, and the engagement between the engaging portion 34 and the connecting portion 20 is released by the mating lock portion pushing the engaging portion 34 downward. That is, the slide holder 3 can be moved from the temporary locking position to the main locking position.

Figure 11A:
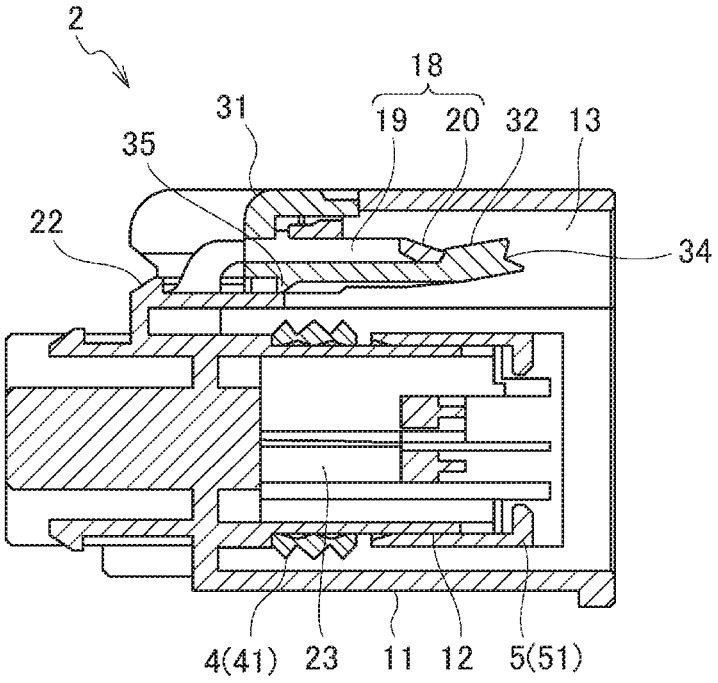
FIG. 11A is a cross-sectional view taken along a line 11(*a*)-11(*a*) of FIG. 10B.
Figure 11B:
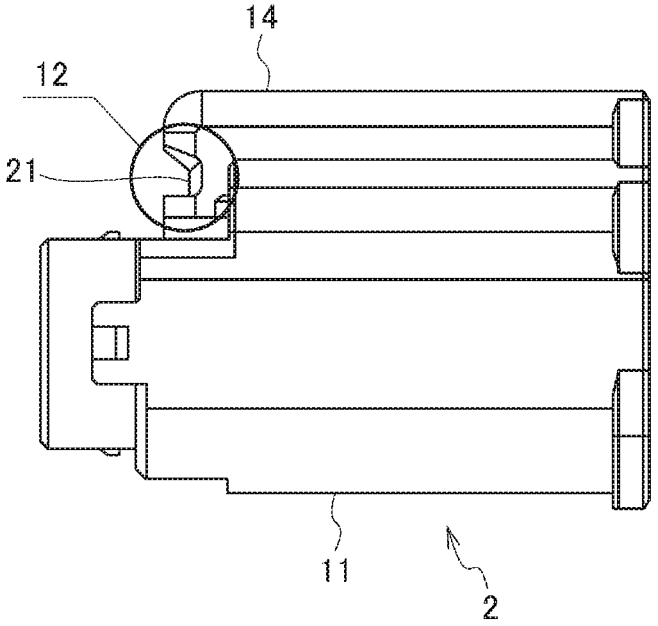
FIG. 11B is a side view of the housing in a state in which the slide holder is in the main locking position.

Therefore, in the completely fitted state, by pushing the slide holder 3 in the temporary locking position forward, the slide holder 3 is moved to the main locking position as shown in FIGS. 11A and 11B. Meanwhile, in the incompletely fitted state, since the mating lock portion does not push the engaging portion 34 downward and the engagement between the engaging portion 34 and the connecting portion 20 is not released, the slide holder 3 cannot move from the temporary locking position to the main locking position. As described above, since the slide holder 3 cannot move from the temporary locking position to the main locking position, the incompletely fitted state between the housing 2 and the mating housing can be easily detected.

Figure 9:
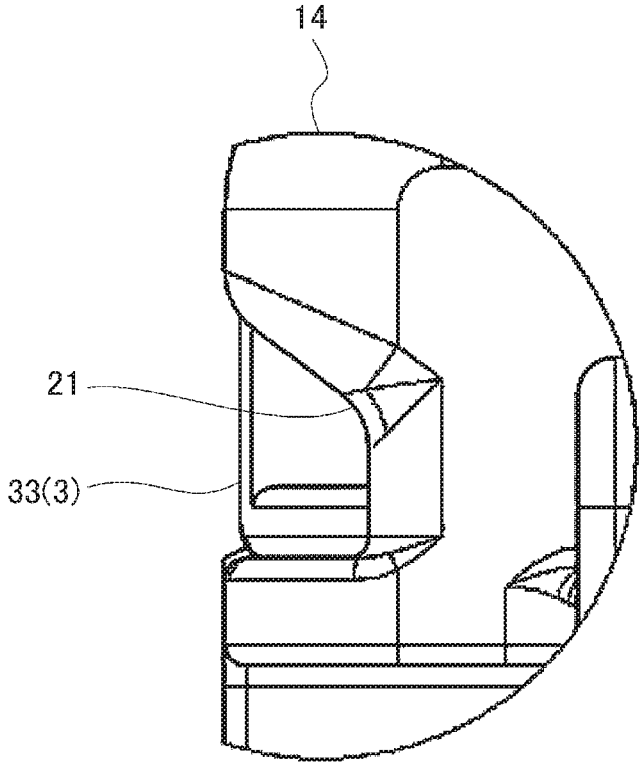
FIG. 9 is an enlarged view of inside of a frame indicated by a reference numeral 9 in FIG. 8B.
Figure 10A:
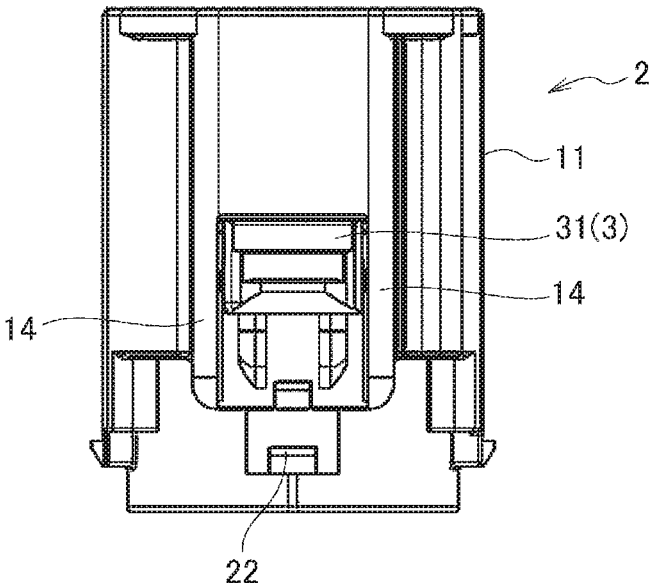
FIGS. 10A and 10B are views corresponding to FIGS. 2A and 2B in a state in which the slide holder is in a main locking position.
Figure 10B:
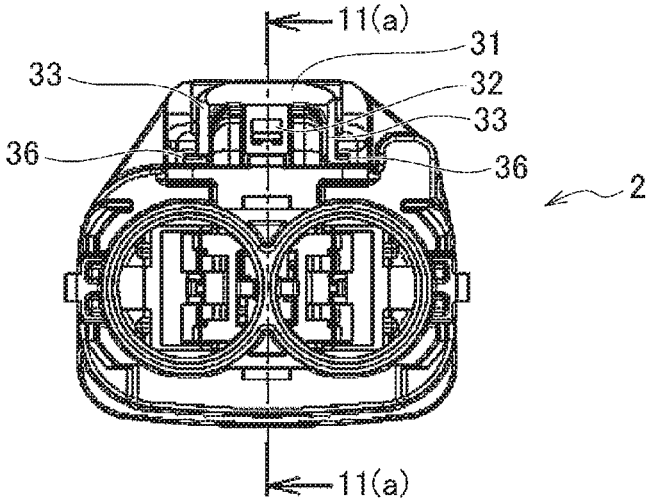
Figure 12:
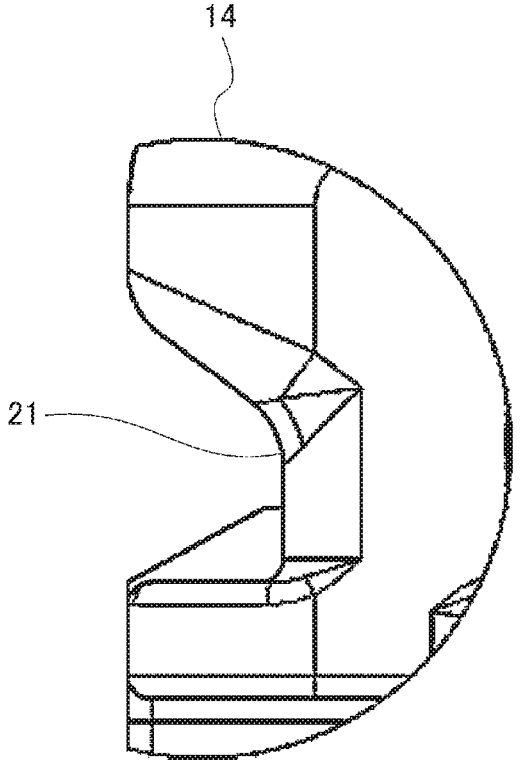
FIG. 12 is an enlarged view of inside of a frame indicated by a reference numeral 12 in FIG. 11B.

Hereinafter, the function of the pair of notches 21 provided in the pair of protective walls 14 will be described. As shown in FIGS. 8B and 9, in a state in which the slide holder 3 is in the temporary locking position, when the housing 2 is viewed from the width direction, a part of the side plate portion 33 of the slide holder 3 can be visually recognized via the notch 21. Meanwhile, as shown in FIGS. 11B and 12, in a state in which the slide holder 3 is in the main locking position, when the housing 2 is viewed from the width direction, the part (the same part) of the side plate portion 33 of the slide holder 3 cannot be visually recognized via the notch 21.

As a result, when the notch 21 of the housing 2 is viewed from the width direction, it is easily visible whether the slide holder 3 mounted on the housing 2 including the pair of protective walls 14 is in the temporary locking position. The configuration of the portion related to the mounting of the slide holder 3 on the housing 2 and the configuration of the slide holder 3 have been described above. Next, a configuration of a portion related to the mounting of the front holder 5 on the housing 2 and a configuration of the front holder 5 will be described.

<Portion Related to Mounting of Front Holder on Housing 2 and Front Holder 5>

Figure 17:
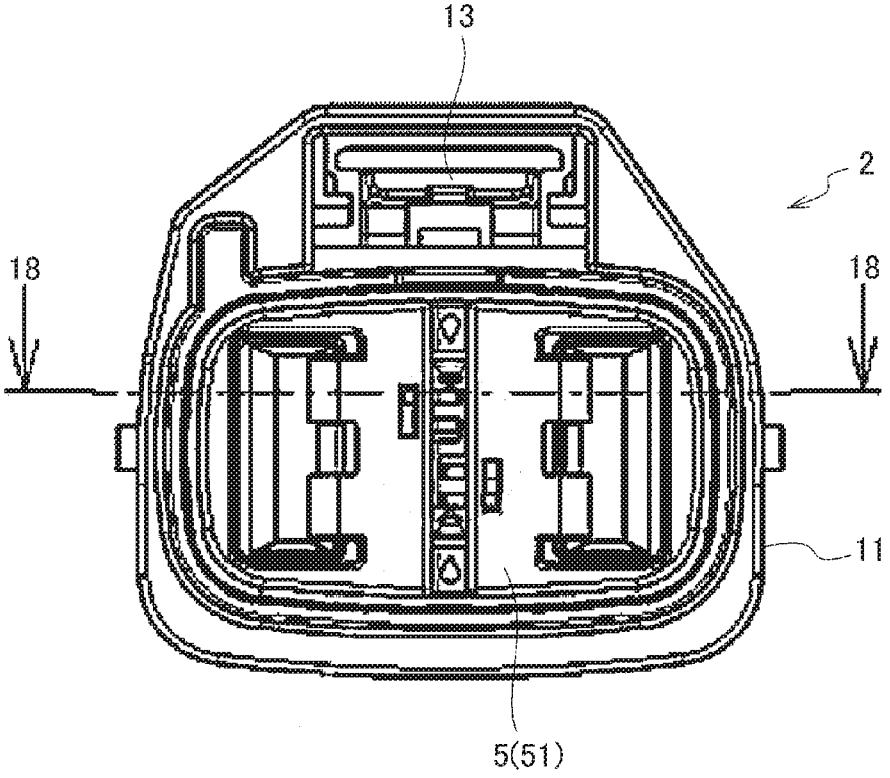
FIG. 17 is a front view of the housing in a state in which the front holder is in the temporary locking position.
Figure 18:
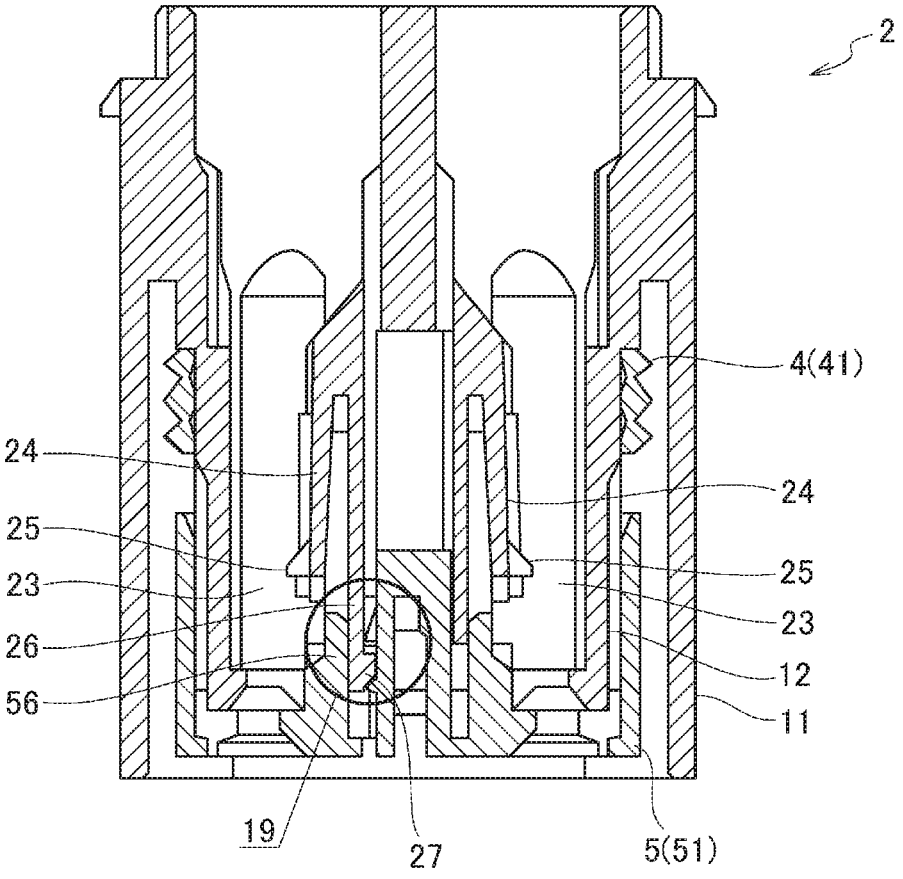
FIG. 18 is a cross-sectional view taken along a line 18-18 of FIG. 17.

First, the portion related to the mounting of the front holder 5 on the housing 2 will be described. As shown in FIGS. 17 and 18, a terminal housing chamber 23 for housing a terminal (not shown) is formed in the terminal housing portion 12 of the housing 2 so as to extend in the front-rear direction. In this example, two terminal housing chambers 23 are provided so as to be aligned in the width direction.

In each terminal housing chamber 23, a cantilever-shaped lance 24 which is elastically deformable in the width direction so as to face the inside of the terminal housing chamber 23 from the inside in the width direction is provided so as to extend forward from a substantially central position in the front-rear direction of the terminal housing chamber 23. A lance protrusion 25 extending toward the inside of the terminal housing chamber 23 is integrally formed at a tip end of the lance 24. By locking a predetermined corner of the terminal inserted into the terminal housing chamber 23 from the rear side with the lance protrusion 25, the locking lance 24 exerts a function of preventing the terminal from coming out toward the rear side.

When the terminal is in a normal insertion position (in a state in which the lance 24 exerts a retaining function) in the terminal housing chamber 23, the lance protrusion 25 enters the corner of the terminal, so that the lance 24 is maintained in a normal posture (posture shown in FIG. 18) without elastic deformation. Meanwhile, when the terminal is in the halfway insertion position (in a state in which the lance 24 does not exert the retaining function), the lance 24 is maintained in a posture of being elastically deformed inward in the width direction (a side away from the terminal) due to a fact that the lance protrusion 25 cannot enter the corner of the terminal.

Figure 20:
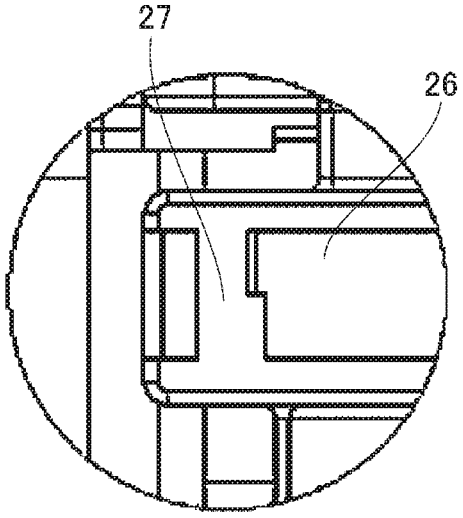
FIG. 20 is a side view of a tip portion including a protrusion in a protrusion support portion of the housing.

In a widthwise inner region of the lance 24 provided in each terminal housing chamber 23 (a region away from the terminal housing chamber 23), a cantilever-shaped protrusion support portion 26 which has a gap in the width direction with the lance 24 and is elastically deformable in the width direction is provided so as to extend forward from a position near a base portion of the lance 24. A protrusion 27 (see also FIGS. 1 and 20) that protrudes inward in the width direction and extends in the upper-lower direction is provided on a widthwise inner side surface of a tip end of the protrusion support portion 26. The protrusion 27 of the protrusion support portion 26 has a function of locking the front holder 5 to the temporary locking position and the main locking position (to be described later).

Figure 13:
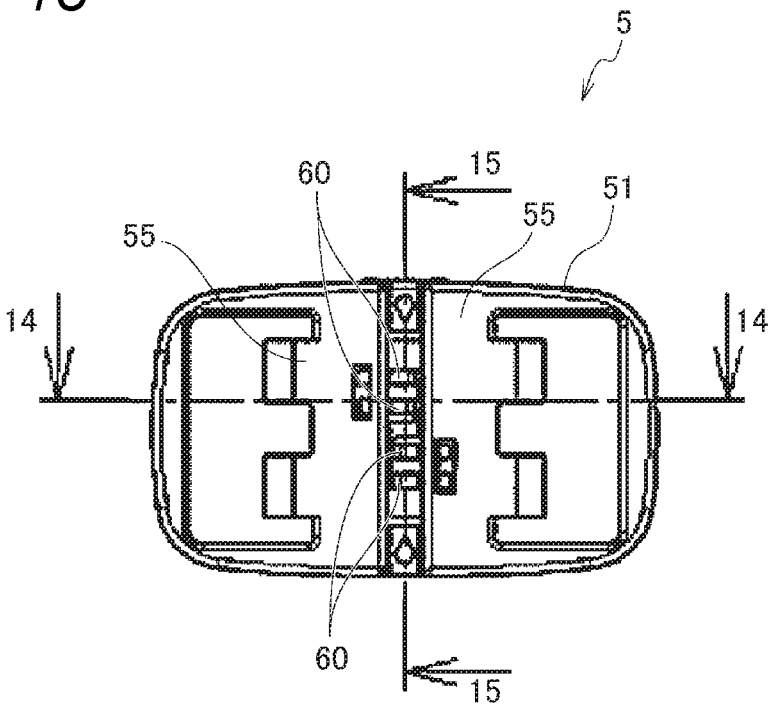
FIG. 13 is a front view of a front holder shown in FIG. 1.
Figure 14:
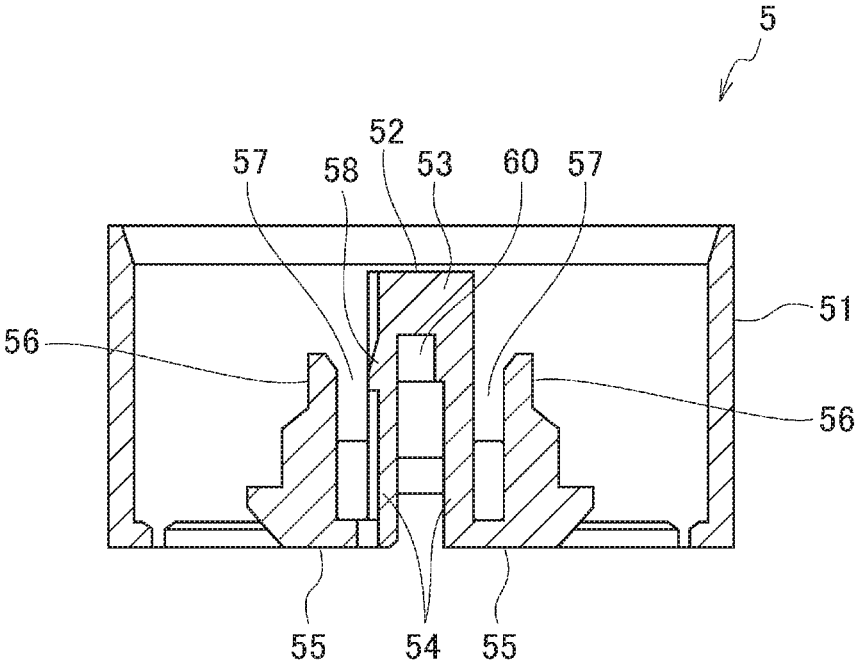
FIG. 14 is a sectional view taken along a line 14-14 of FIG. 13.
Figure 15:
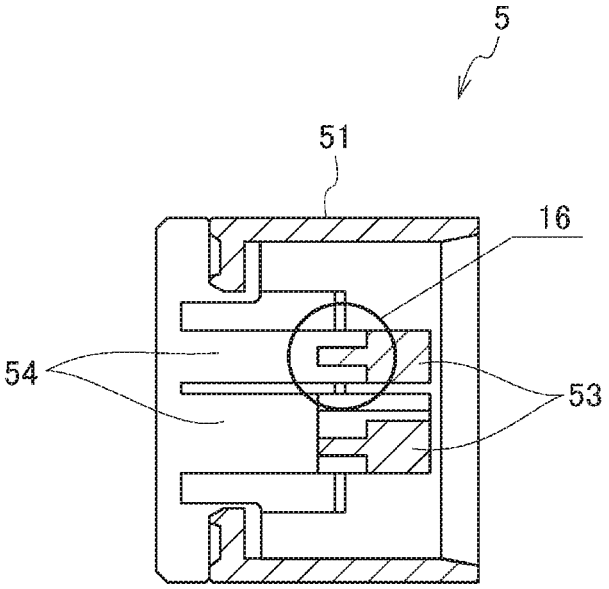
FIG. 15 is a sectional view taken along a line 15-15 of FIG. 13.

Next, the front holder 5 will be described. As shown in FIGS. 13 to 15, the front holder 5 made of resin includes the frame body portion 51 having a rectangular cylindrical shape. A functional portion 52 is integrally provided inside the frame body portion 51.

As shown in FIG. 14, the functional portion 52 integrally includes a base portion 53, a pair of locking arms 54 extending forward from both end portions of the base portion 53 in the width direction, a pair of extending portions 55 extending outward in the width direction from tip end portions of the pair of locking arms 54, and a pair of detection arms 56 extending rearward from widthwise outer side end portions of the pair of extending portions 55. Since the pair of extending portions 55 is integrated with the frame body portion 51, the entire functional portion 52 is formed integrally with the frame portion 51. A gap 57 in the width direction exists between the locking arm 54 and the detection arm 56.

Hereinafter, for convenience of description, only a configuration of a left side portion of the functional portion 52 in FIG. 14 will be described, but a right side portion of the functional portion 52 has a similar configuration.

Figure 22:
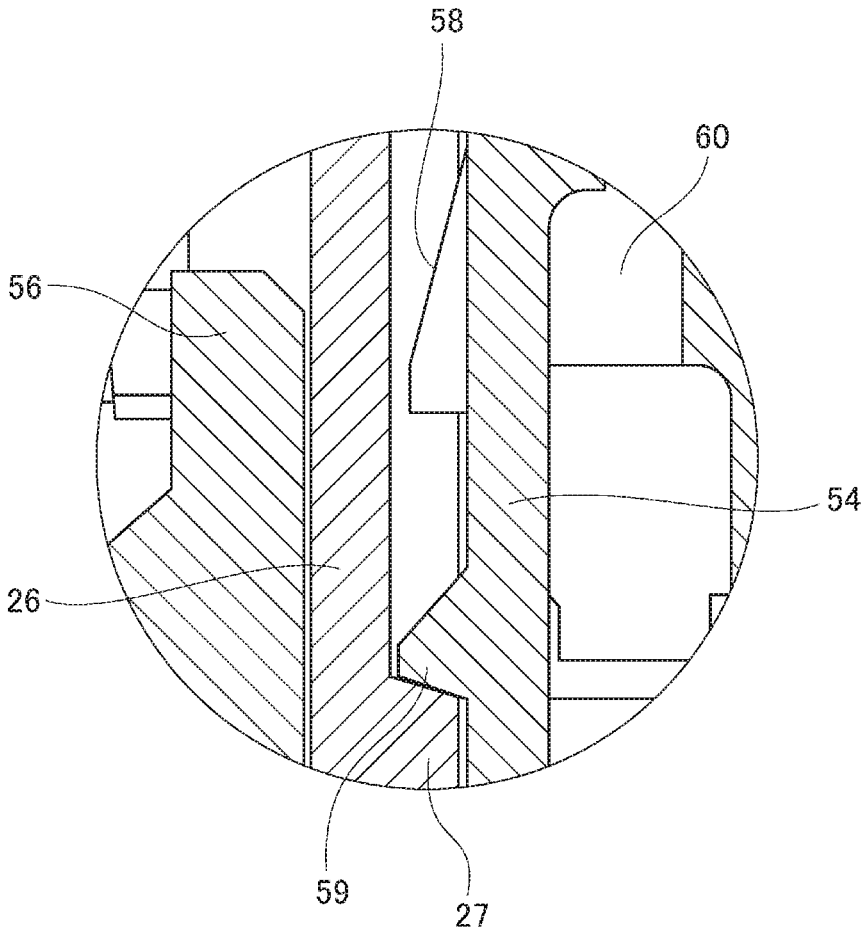
FIG. 22 is an enlarged view of inside of a frame indicated by a reference numeral 22 in FIG. 21.

The locking arm 54 extending in the front-rear direction has a both-end supported beam shape which is elastically deformable in the width direction, in which a root portion (rear end side) is supported by the base portion 53 and a tip end portion (front end side) is supported by the extending portion 55. A temporary locking protrusion 58 and a main locking protrusion 59 are provided on a widthwise outer side surface of the locking arm 54 (see also FIGS. 19 and 22).

The temporary locking protrusion 58 is provided at the root portion of the locking arm 54, and the locking protrusion 59 is provided at a position forward of the temporary locking protrusion 58. The temporary locking protrusion 58 and the main locking protrusion 59 are disposed at mutually different positions in the upper-lower direction for the convenience of manufacture.

Figure 16:
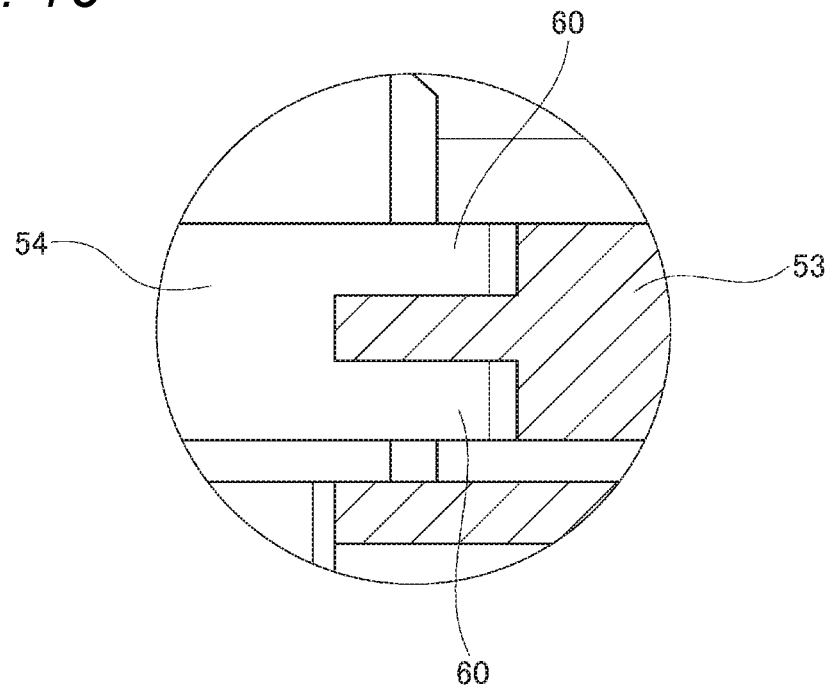
FIG. 16 is an enlarged view of inside of a frame indicated by a reference numeral 16 in FIG. 15.

As shown in FIGS. 13 to 15, a plurality of recesses 60 recessed rearward are formed in a front end surface between the root portions of the pair of locking arms 54 in the base portion 53 (see also FIG. 16). By forming the recesses 60 in this manner, even if a thickness of the base portion 53 in the front-rear direction is increased and a length of the locking arm 54 is shortened, it is possible to effectively suppress generation of sinks and voids at the time of molding due to the increase in the thickness of the base portion 53 in the front-rear direction.

One of the plurality of recesses 60 is formed at a position facing a surface on a side opposite to the side where the temporary locking protrusion 58 is formed on the root portion of the locking arm 54. As a result, a thickness of the temporary locking protrusion 58 in protrusion direction (that is, the width direction) on the locking arm 54 at the place where the temporary locking protrusion 58 is formed is reduced. As a result, the locking arm 54 around the temporary locking protrusion 58 is easily elastically deformed so as to reduce a protruding height of the temporary locking protrusion 58 from the locking arm 54.

When the front holder 5 described above is mounted on the housing 2, first, the rectangular cylindrical packing 4 made of rubber (see FIG. 1) is inserted into an annular gap between the outer cylindrical portion 11 and the terminal housing portion 12 of the housing 2 and fixed to a predetermined position on an outer periphery of the terminal housing portion 12 (see FIG. 18). A plurality of (three in this example) annular lip portions 41 are formed on an outer peripheral surface of the packing 4. The annular lip portion 41 performs a function of sealing the mating housing and the housing 2 in a watertight manner when the mating housing is fitted into the housing 2.

Next, the front holder 5 is inserted into the annular gap from the front side. At this time, as shown in FIG. 18, the protrusion support portion 26 of the housing 2 is inserted into the gap 57 of the front holder 5. When the front holder 5 is inserted into the annular gap, the temporary locking protrusion 58 of the front holder 5 comes into contact with the protrusion 27 of the support portion 26.

After the temporary locking protrusion 58 comes into contact with the protrusion 27, the temporary locking protrusion 58 rides on the protrusion 27 by elastically deforming the locking arm 54 and the protrusion support portion 26 in a direction (width direction) away from each other as the insertion proceeds. Here, as described above, since the protrusion support portion 26 is elastically deformed in a direction (width direction) away from the temporary locking protrusion 58, and the locking arm 54 around the temporary locking protrusion 58 is easily elastically deformed so as to reduce the protruding height of the temporary locking protrusion 58 from the locking arm 54, it is possible to effectively suppress crushing of the contact portions when temporary locking protrusion 58 rides over the protrusion 27.

Figure 19:
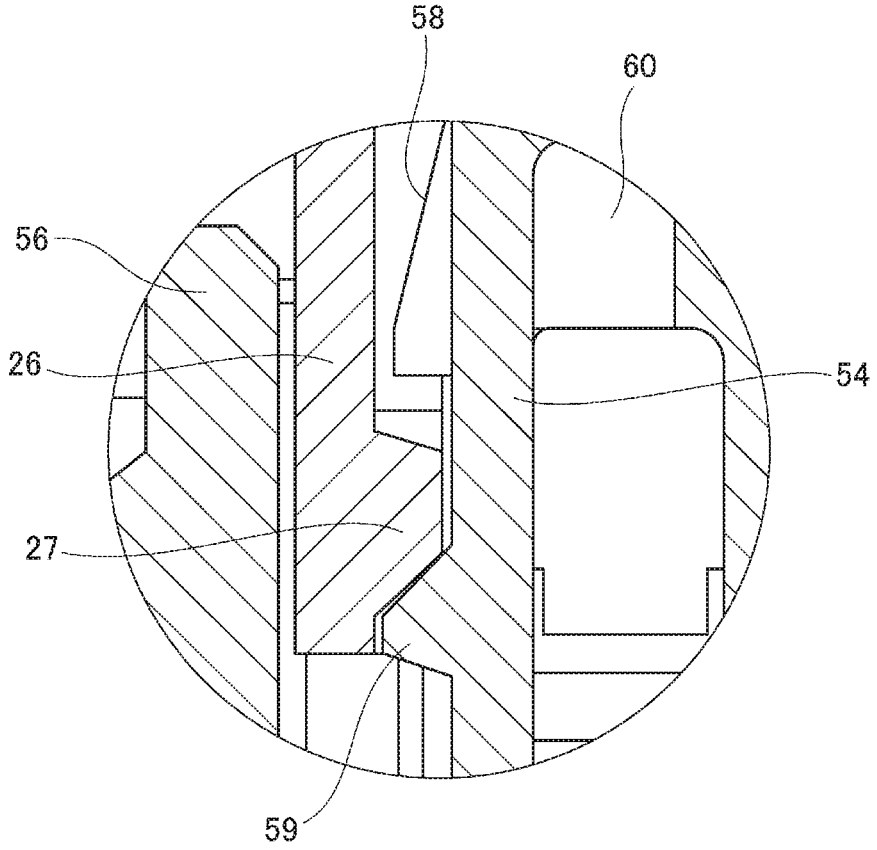
FIG. 19 is an enlarged view of inside of a frame indicated by a reference numeral 19 in FIG. 18.

Thereafter, as the insertion proceeds, the temporary locking protrusion 58 rides over the protrusion 27, so that the locking arms 54 and the protrusion support portion 26 are elastically returned. As a result, as shown in FIGS. 18 and 19, when the temporary locking protrusion 58 is located rearward of the protrusion 27 and the main locking protrusion 59 is located forward of the protrusion 27, by engaging the temporary locking protrusion 58, the main locking protrusion 59 with the protrusion 27, the front holder 5 is held at the temporary locking position.

Figure 21:
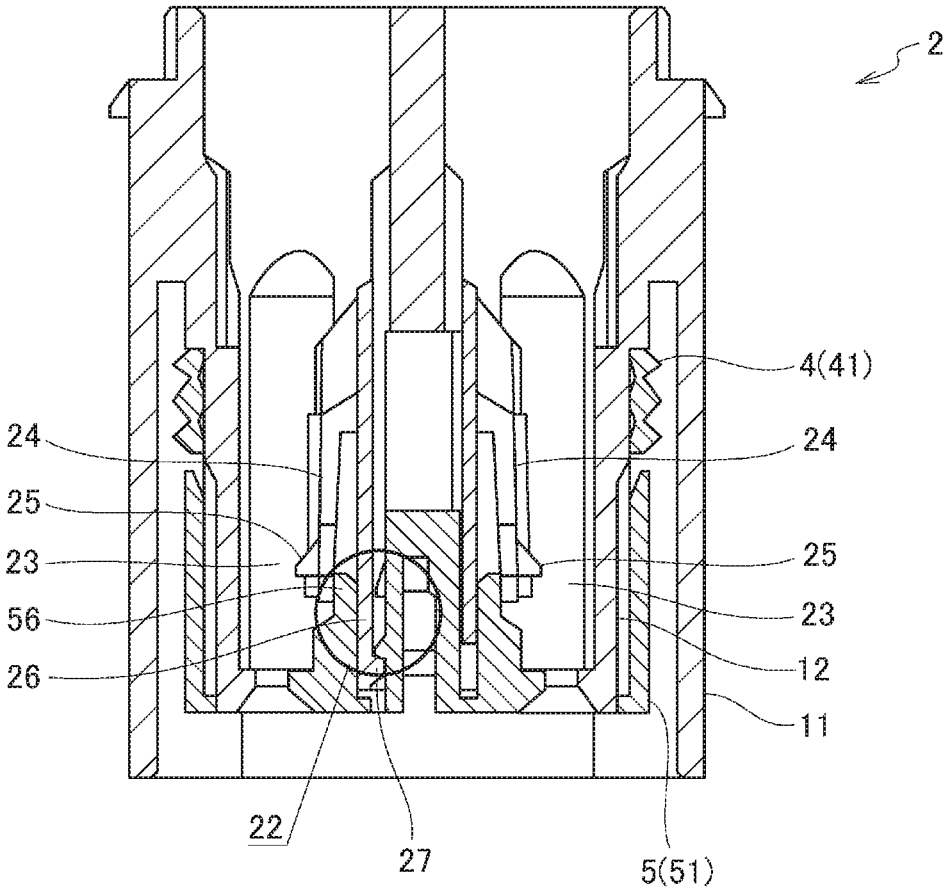
FIG. 21 is a view corresponding to FIG. 18 in a state in which the front holder is in the main locking position.

In this state, when the terminal is inserted into the terminal housing chamber 23 to the normal insertion position, as described above, the lance 24 is maintained in the normal posture (the posture shown in FIG. 18). Therefore, it is possible to obtain a state in which a tip end portion of the detection arm 56 of the front holder 5 can enter a gap between the lance 24 and the protrusion support portion 26. Therefore, in a state in which the terminal is in the normal insertion position, when the front holder 5 in the temporary locking position is pushed rearward, as shown in FIG. 21, the front holder 5 moves to the main locking position by the tip end portion of the detection arm 56 entering the gap between the lance 24 and the protrusion support portion 26. At this time, when the main locking protrusion 59 rides over the protrusion 27 and the main locking protrusion 59 is located rearward of the protrusion 27, the front holder 5 is held in the main locking position by engaging the main locking protrusion 59 with the protrusion 27.

On the other hand, in a state in which the terminal is in the halfway insertion position, as described above, the lance 24 is maintained in the posture of being elastically deformed inward in the width direction (the side away from the terminal). Therefore, the gap between the lance 24 and the protrusion support portion 26 is narrowed, so that the tip end portion of the detection arm 56 cannot enter the gap between the lance 24 and the protrusion support portion 26. As a result, the front holder 5 cannot move from the temporary locking position to the main locking position. In this way, since the front holder 5 cannot move from the temporary locking position to the main locking position, it is possible to easily detect the halfway insertion of the terminal.

<Functions and Effects>

According to the connector 1 of the embodiment of the present invention, the pair of protective walls 14 is provided with the notches 21 respectively which make a part of the slide holder 3 visible when the slide holder 3 is in the temporary locking position, and make the part (same part) of the slide holder 3 invisible when the slide holder 3 is in the main locking position when viewed from the width direction. As a result, it is easily visible from the width direction of the housing 2 whether the slide holder 3 mounted on the housing 2 having the pair of protective walls 14 is in the temporary locking position.

Further, according to the connector 1, guide structures constituted by the guide ribs 36 of the slide holder 3 and the guide grooves 16 of the protective walls 14 are provided with relief portions constituted by the tapered portions 17, 37. As a result, in a state in which the slide holder 3 is inclined with respect to the housing 2 so as to avoid interference of the locking structures constituted by the protrusion 22 of the housing 2 and the protrusion 35 of the slide holder 3, the slide holder 3 can be smoothly mounted on the housing 2 and locked in the temporary locking position by using the guide structures without the interference of the locking structures. As a result, an engagement margin of the locking structures (the protrusion 22 and the protrusion 35) can be increased, and the slide holder 3 can be more reliably locked in the temporary locking position.

<Other Embodiments>

The present invention is not limited to the above embodiment, and various modifications can be adopted within the scope of the present invention. For example, the present invention is not limited to the above-described embodiment, and can be appropriately modified, improved or the like. In addition, materials, shapes, sizes, numbers, arrangement places or the like of constituent elements in the above embodiment are optional and not limited as long as the object of the present invention can be achieved.

In the above embodiment, the notch 21 is provided so as to be recessed forward on the rear end surface of each protective wall 14. In contrast, the notch can be provided at any position of the protective wall 14 as long as the part of the slide holder 3 is visible when the slide holder 3 is in the temporary locking position, and the part of the slide holder 3 is invisible when the slide holder 3 is in the main locking position.

Further, in the above embodiment, the guide structures constituted by the guide ribs 36 of the slide holder 3 and the guide grooves 16 of the protective walls 14 are provided with the relief portions constituted by the tapered portions 17, 37, but the relief portion may not be provided. Further, the guide structures may be configured by guide grooves of the slide holder 3 and guide ribs of the protective wall 14.

Further, characteristics of the embodiment of the connector 1 according to the present invention described above will be briefly summarized in the following [1] and [2].

[1] A connector (1) comprising:

a housing (2); and a slide holder (3), wherein the housing (2) includes a lock portion (18) maintaining a completely fitted state with a mating housing, wherein the slide holder (3) that is configured to be mounted on the housing (2) so as to be movable in a fitting direction of the housing (2) and the mating housing between a temporary locking position and a main locking position, and is movable from the temporary locking position to the main locking position while avoiding interference with the lock portion (18) only in the completely fitted state, wherein the housing (2) includes a pair of protective walls (14) extending in the fitting direction so as to sandwich the lock portion (18) and the slide holder (3) in a width direction orthogonal to the fitting direction, and wherein the protective wall (14) includes a notch (21) which makes a part of the slide holder (3) visible when the slide holder (3) is in the temporary locking position, and makes the part of the slide holder (3) invisible when the slide holder (3) is in the main locking position when viewed from the width direction.

[2] The connector (1) according to the above [1], wherein the housing (2) and the slide holder (3) include locking structures (22, 35) for locking the slide holder (3) in the temporary locking position, wherein the slide holder (3) and the pair of protective walls (14) include guide structures (16, 36) that guide the movement of the slide holder (3) with respect to the housing (2), and wherein the guide structures (16, 36) have relief portions (17, 37) for making the slide holder (3) inclined with respect to the housing (2) in a direction in which the interference of the locking structures (22, 35) is avoided when the slide holder (3) is mounted on the housing (2).

REFERENCE SIGNS LIST

1 connector
2 housing
3 slide holder
14 protective wall
16 guide groove (guide structure)
17 tapered portion (relief portion)
18 lock portion
21 notch
22 protrusion (locking structure)
35 protrusion (locking structure)
36 guide rib (guide structure)
37 tapered portion (relief portion)

What is claimed is:

1. A connector comprising:

a housing; and a slide holder, wherein the housing includes a lock portion maintaining a completely fitted state with a mating housing, wherein the slide holder is configured to be mounted on the housing so as to be movable in a fitting direction of the housing and the mating housing between a temporary locking position and a main locking position, and is movable from the temporary locking position to the main locking position while avoiding interference with the lock portion only in the completely fitted state, wherein the housing includes a pair of protective walls extending in the fitting direction so as to sandwich the lock portion and the slide holder in a width direction orthogonal to the fitting direction, and wherein the protective wall includes a notch which makes a part of the slide holder visible when the slide holder is in the temporary locking position, and makes the part of the slide holder invisible when the slide holder is in the main locking position when viewed from the width direction.

2. The connector according to claim 1, wherein the housing and the slide holder include locking structures for locking the slide holder in the temporary locking position, wherein the slide holder and the pair of protective walls include guide structures that guide the movement of the slide holder with respect to the housing, and wherein the guide structures have relief portions for making the slide holder inclined with respect to the housing in a direction in which the interference of the locking structures is avoided when the slide holder is mounted on the housing.

* * * * *